US009373286B2

(12) United States Patent
Ruckmongathan

(10) Patent No.: US 9,373,286 B2
(45) Date of Patent: Jun. 21, 2016

(54) METHOD TO DISPLAY AN IMAGE ON A DISPLAY DEVICE

(75) Inventor: Temkar N. Ruckmongathan, Bangalore (IN)

(73) Assignee: Raman Research Institute, Bangalore (IN)

( * ) Notice: Subject to any disclaimer, the term of this patent is extended or adjusted under 35 U.S.C. 154(b) by 611 days.

(21) Appl. No.: 13/614,218

(22) Filed: Sep. 13, 2012

(65) Prior Publication Data

US 2013/0063469 A1 Mar. 14, 2013

(30) Foreign Application Priority Data

Sep. 13, 2011 (IN) ..... 3138/CHE/2011

(51) Int. Cl.
*G09G 3/34* (2006.01)
*G09G 3/20* (2006.01)

(52) U.S. Cl.
CPC ..... *G09G 3/342* (2013.01); *G09G 3/2022* (2013.01); *G09G 2310/024* (2013.01); *G09G 2320/0626* (2013.01)

(58) Field of Classification Search
CPC ... G09G 3/2033; G09G 3/2037; G09G 3/342; G09G 2320/0247
See application file for complete search history.

(56) References Cited

U.S. PATENT DOCUMENTS 6,985,164 B2 * 1/2006 Rogers et al. ..... 345/692
2003/0063077 A1 * 4/2003 Koyama ..... 345/204
2005/0168490 A1 * 8/2005 Takahara ..... 345/690
2005/0248591 A1 * 11/2005 Feng ..... G09G 3/3426 345/690
2011/0261094 A1 10/2011 Ruckmongathan
2011/0292018 A1 * 12/2011 Kubota et al. ..... 345/211

OTHER PUBLICATIONS

T. N. Ruckmongathan; An Addressing Technique to Drive Blue Phase LCDs;LCT5-4L (late News paper) Raman Research Institute, C V Raman Avenue, Sadashivangar, Bangalore 560080 India, Society of Information Display, 2010, p. 607.
T. N. Ruckmongathan; Bit Slice Addressing of Fast Switching Bi-Stable Displays and Multi-Bit Slice Addressing of Active Matrix Liquid Crystal Displays; Journal of Display Technology. vol. 8. No. 4. Apr. 2012. p. 198.
T. N. Ruckmongathan; Intensity Modulation of Light Sources for Gray Scales in Projection Displays;SID 2012 Digest . 591; Raman Research Institute, Bengaluru, Karnataka, India.

* cited by examiner

*Primary Examiner* — James A Thompson
(74) *Attorney, Agent, or Firm* — Panitch Schwarze Belisario & Nadel LLP

(57) ABSTRACT

In one embodiment, a method a method of displaying an image on a display device is described. The display device includes a plurality of clusters. Each cluster has a plurality of pixels and an independent light source associated therewith. Each of the plurality of clusters are illuminated with their associated independent light source. The plurality of pixels in a cluster are refreshed with bits of gray scale. Simultaneously with the refreshing, the light source associated with the cluster where the plurality of pixels are being refreshed is switched off. When the plurality of pixels have been refreshed, the light source is switched on with a predetermined intensity of light. Each of the clusters are refreshed at a rate that is fast enough to eliminate flicker.

15 Claims, 16 Drawing Sheets
(7 of 16 Drawing Sheet(s) Filed in Color)

Red 8-bits Green 8-bits Blue8-bits

| Image | Bit frame | Number of clusters of 256 pixels | |
|---|---|---|---|
| | | Transparent (ON) | Opaque (OFF) |
| Barbara | 8 | 119 | 260 |
| | 7 | 57 | 109 |
| | 6 | 28 | 44 |
| Harbour | 8 | 275 | 135 |
| | 7 | 88 | 48 |
| | 6 | 20 | 21 |
| Lena | 8 | 260 | 192 |
| | 7 | 107 | 170 |
| | 6 | 15 | 67 |
| Living room | 8 | 103 | 146 |
| | 7 | 34 | 67 |
| | 6 | 8 | 10 |
| Peppers | 8 | 229 | 260 |
| | 7 | 107 | 143 |
| | 6 | 19 | 21 |
| Lake | 8 | 209 | 71 |
| | 7 | 0 | 201 |
| | 6 | 12 | 37 |

Fig. 20

METHOD TO DISPLAY AN IMAGE ON A DISPLAY DEVICE

CROSS-REFERENCE TO RELATED APPLICATIONS

This application claims the benefit of Indian Provisional Patent Application No. 3138/CHE/2011, filed on 13 Sep. 2011, entitled "A METHOD TO DISPLAY AN IMAGE ON A DISPLAY DEVICE", the entire contents of which are incorporated herein by reference in their entirety.

BACKGROUND OF THE INVENTION

The disclosure relates to display devices and more particularly relates to bit slice addressing of Liquid Crystal Display (LCD) and multi bit-slicing of Active Matrix LCD (AM-LCD).

Pixels are interconnected such that each pixel can be addressed uniquely with a row and a column electrode in LCD. Therefore, LCD has as many digital to analog converters (DACs) as the number of columns in the display to control intensity of pixels whereas just three DACs are adequate to control the intensity of pixels in CRT. It is desirable to have a mechanism which is similar to z-modulation of CRT to control intensity of pixels in flat panel displays.

Bit Slice Addressing (BSA) proposed by T. N. Ruckmongathan in "An addressing technique to drive blue phase LCDs," Publisher: Society for Information Display, IDW'10, Proceedings of the international display workshop, p 607, 2010, has the elegance and simplicity of z-modulation of CRT. BSA is based on using fast responding LCD as a dynamic mask to display the bit planes of images sequentially, while simultaneously controlling the intensity of backlight to be proportional to the bit-weight of the bit frame that is displayed. When bit frames of images are displayed in a rapid manner it is perceived as the original image by humans due to the integrating nature of human vision.

BSA replaces the complex DACs (8 to 10-bits) in data drivers with simple level shifters that are equivalent to 1-bit DACs. Power consumption of backlight can be reduced by switching "OFF" parts of backlight that illuminate clusters of pixels that are driven to "OFF" state in bit-plane frames. About 20 to 40% reduction in backlight power can be achieved even in images with good contrast and brightness by selective switching of backlight. A viewing angle characteristic that is independent of gray scales and consequently color purity of images, elimination of motion blur, large voltage margin for switching pixels etc., are some additional advantages of BSA. Ferroelectric LCD, a passive matrix type bistable display and active matrix type blue phase LCD can be driven with BSA. The main stream active matrix LCDs use either IPS (in-plane switching) or VAN (vertically aligned nematic) mode with response times of a few milliseconds. State of the art IPS and VAN LCDs are marginally slow for bit slice addressing. Multi-Bit Slice Addressing (MBSA) is proposed to drive AMLCDs with response times of a few milliseconds it is a trade-off between response time of the panel and hardware complexity of data drivers.

BRIEF SUMMARY OF THE INVENTION

In one embodiment, a method of displaying an image on a display device is described. The display device includes a plurality of clusters. Each cluster has a plurality of pixels and an independent light source associated therewith. Each of the plurality of clusters are illuminated with their associated independent light source. The plurality of pixels in a cluster are refreshed with bits of gray scale. Simultaneously with the refreshing, the light source associated with the cluster where the plurality of pixels are being refreshed is switched off. When the plurality of pixels have been refreshed, the light source is switched on with a predetermined intensity of light. Each of the clusters are refreshed at a rate that is fast enough to eliminate flicker.

In another embodiment, a method of displaying an image on a display device is described. The display device includes a plurality of predefined clusters of pixels, each cluster having an independent light source. Each of the plurality of clusters has a plurality of pixels arranged in rows. The plurality of pixels in a predefined cluster of pixels are sequentially refreshed one row at a time with bits of gray scale during a first time interval. The refreshing drives each pixel to a gray scale based on the applied bits of gray scale. Simultaneously with the refreshing, a light source associated with the predefined cluster of pixels being refreshed is turned off. After the refreshing is completed, the plurality of refreshed pixels of the cluster are displayed by switching on the light source for a subsequent one or more time intervals. An intensity of the light source is determined based on the bits of gray scale used during the refreshing. Each of the predefined clusters are refreshed using a predefined number of bits of gray scale at a predetermined rate such that the displayed clusters of pixels are perceived by a viewer of the display device as a gray scale image without flicker.

In yet another embodiment, a display device for displaying an image with a bit slice addressing technique is described. The display device has a plurality of columns. A plurality of data drivers drive the display device. Each data driver includes a 1-bit shift register, a latch and a power source configured to apply one of two distinct voltages to each column of the display device to display two gray scales. A plurality of light sources illuminate the display device, each light source having an independent intensity control. A controller controls the intensity of the plurality of light sources by (i) varying the number of light sources that are on, and (ii) varying the duration for which the light sources are on.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

The patent or application file contains at least one drawing executed in color. Copies of this patent or patent application publication with color drawing(s) will be provided by the Office upon request and payment of the necessary fee. The color drawings are FIGS. 5-7, 13 and 15-17.

In the drawings:

FIG. 1 is an illustration of bit slice addressing of AMLCD with intensity modulation of backlight for the four clusters of pixels (A, B, C and D);

FIG. 2 is a graph of wide voltage margin to driving pixels, either to ON or OFF states;

FIG. 3 is a graph illustrating that variation of light transmission with viewing angle is small when pixels are driven to ON and OFF states;

FIG. 4 is a graph illustrating intensity modulation of backlight to display 256 gray shades with 8-bits;

FIG. 5 is an image of a Girl used as an example to check percentage of OFF pixels in bit plane, the Girl image is used for image processing;

FIG. 6 is an image of Lena used as another example to check percentage of OFF pixels in bit plane, the Lena image is used for comparing image processing algorithms;

FIG. 7 is an image of a pepper used as another example to check percentage of OFF pixels in bit plane, the Pepper image is used for comparing image processing algorithms;

FIG. 8 is the Girl image of FIG. 5 shown in gray scales of red, green and blue;

FIG. 9 is the Girl image of FIG. 5 showing the most significant bits of the primary colors (red, green and blue);

FIG. 10 is the Girl image of FIG. 5 showing bit frames of bit-7 of primary colors (red, green and blue);

FIG. 11 is the Lena image of FIG. 6 showing bit frames of MSB of primary colors (red, green and blue);

Figure 6:
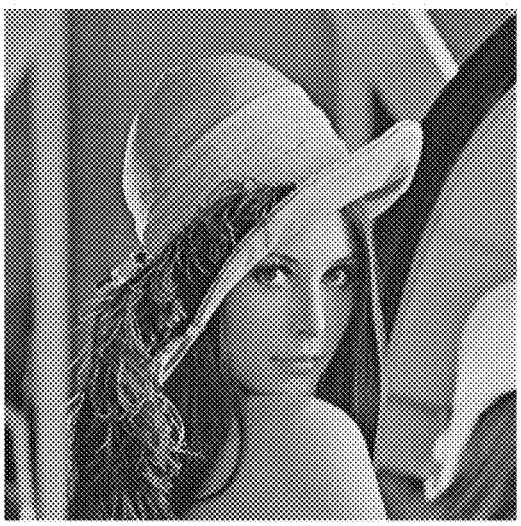
Figure 12:
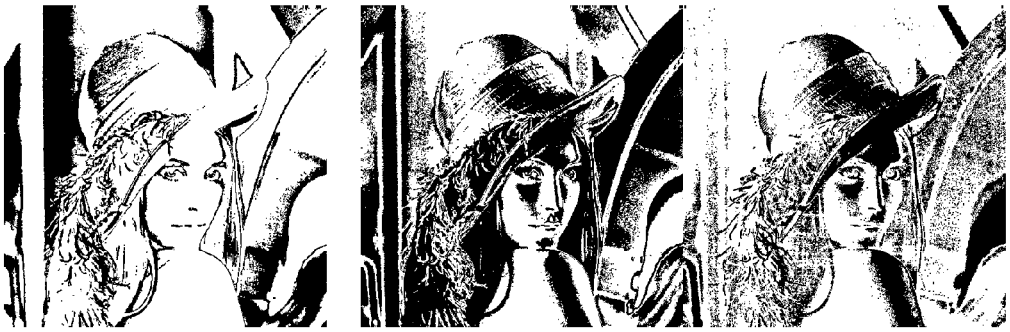
Figure 13:
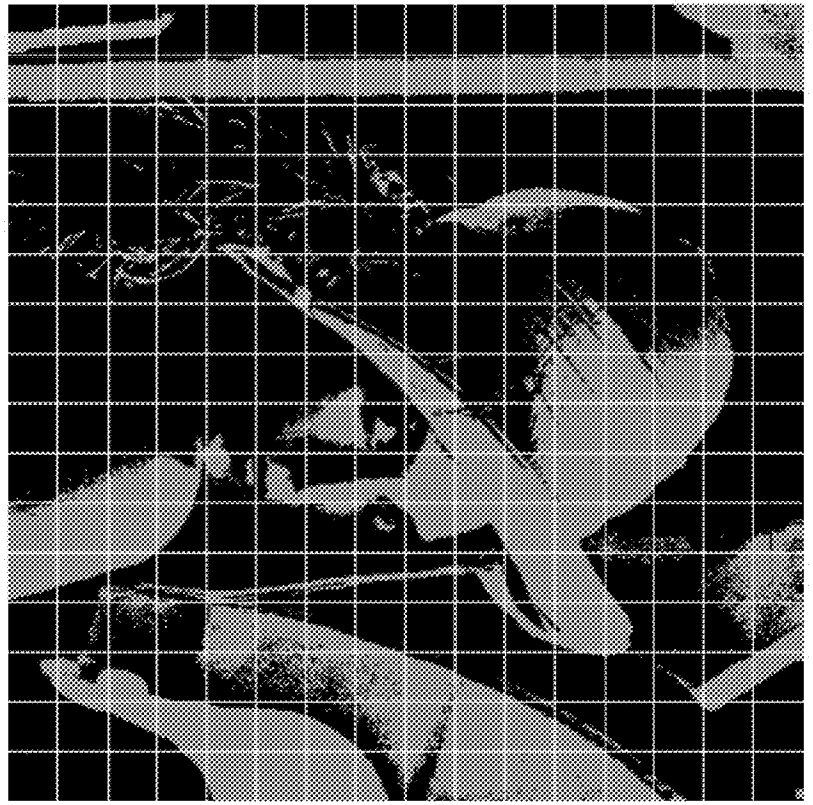
Figure 14:
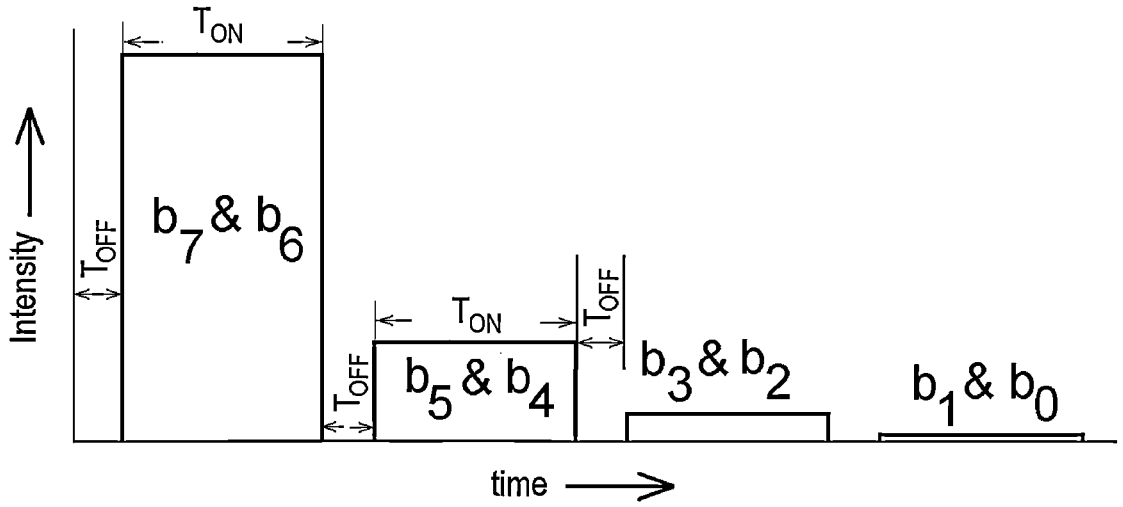
Figure 15:
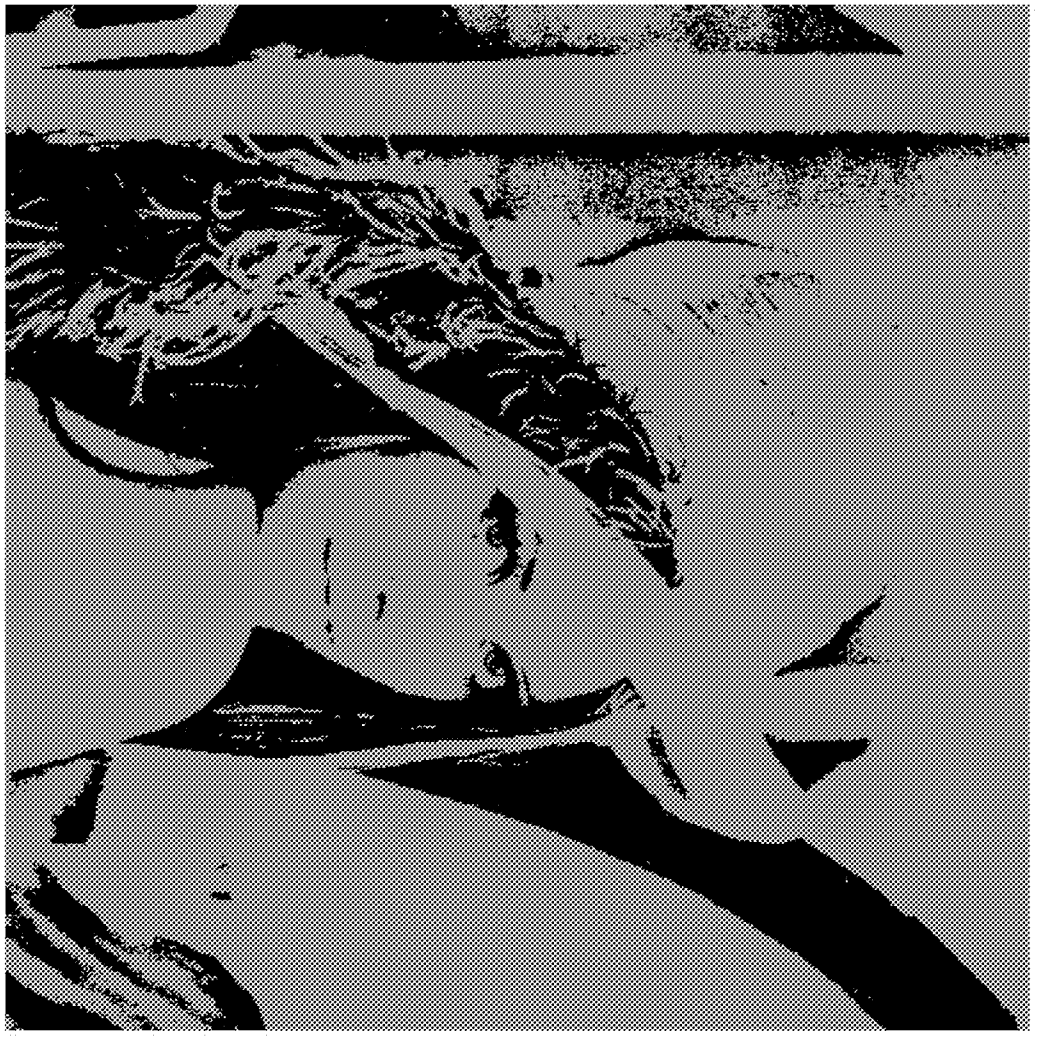
Figure 16:
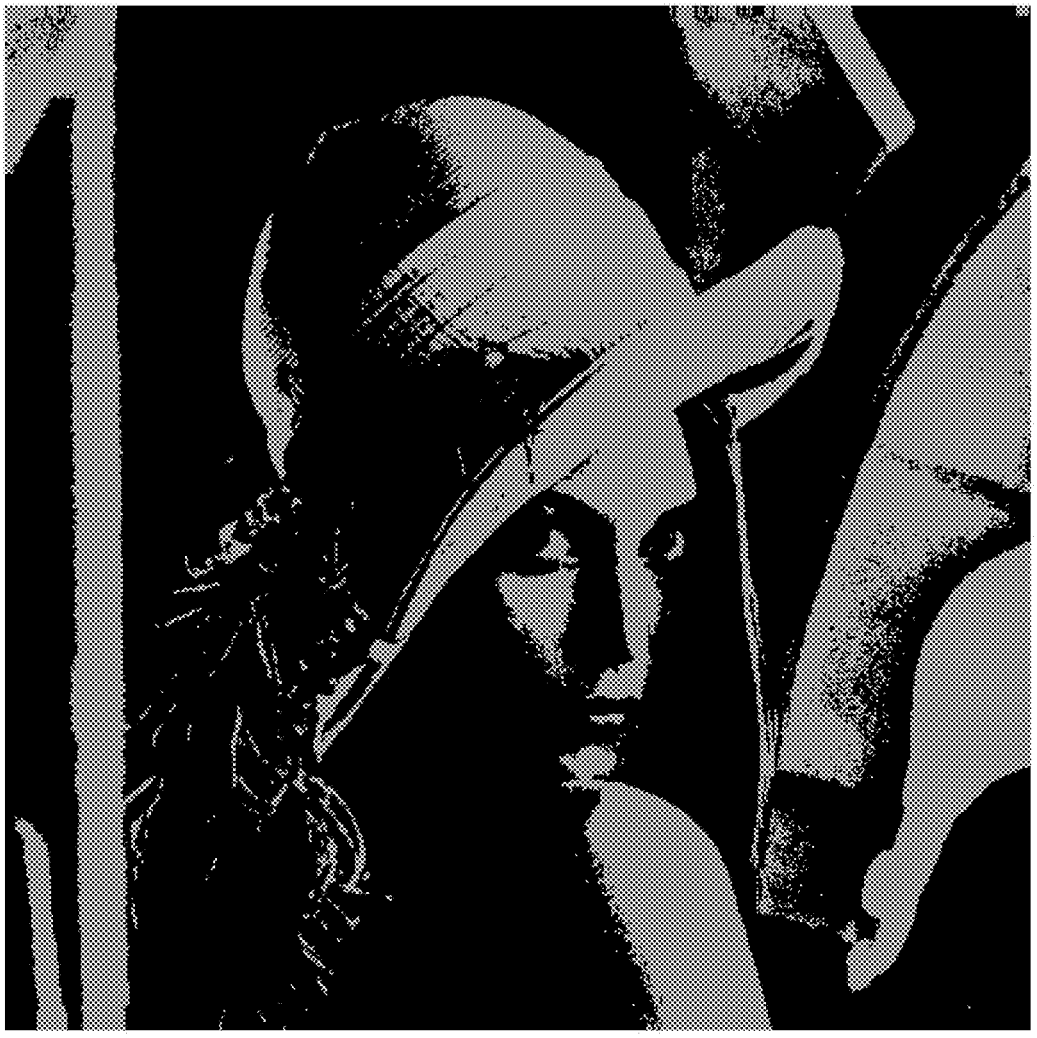
Figure 17:
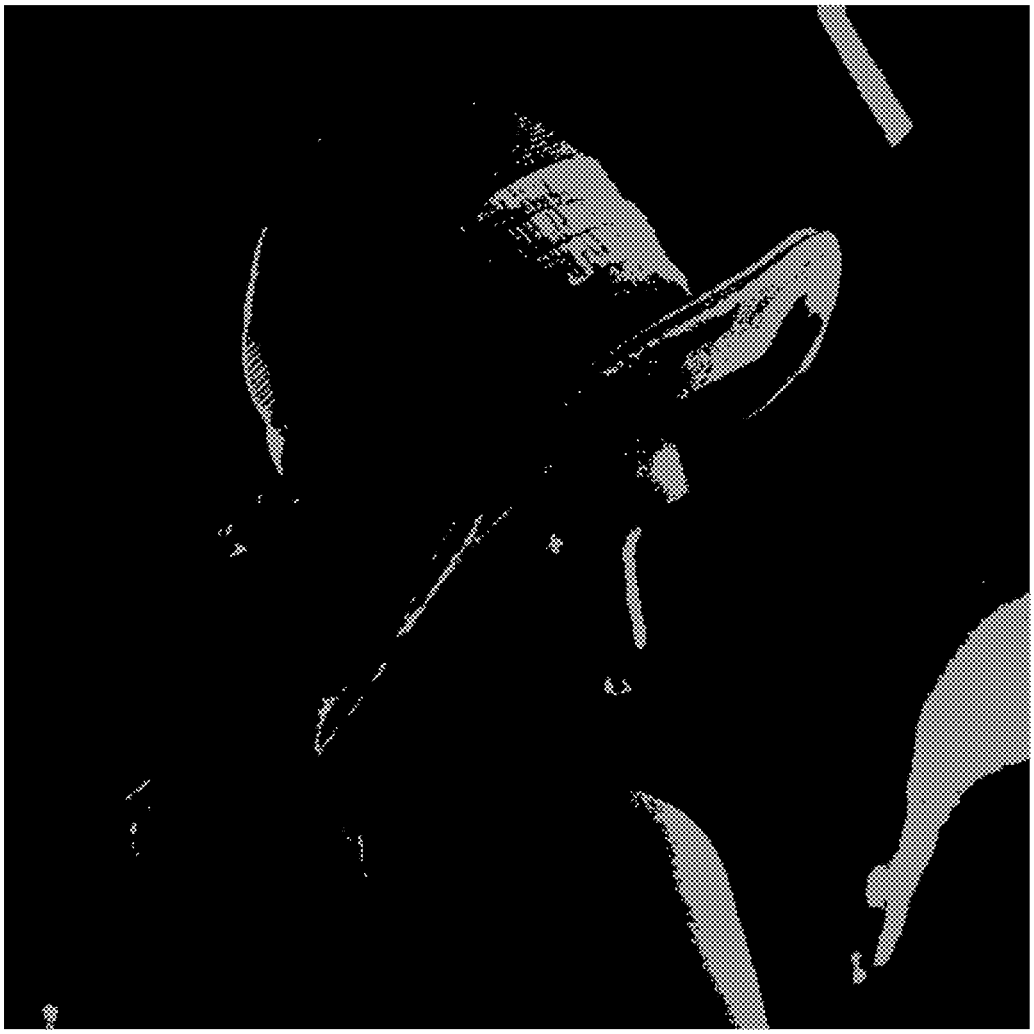
Figure 18:
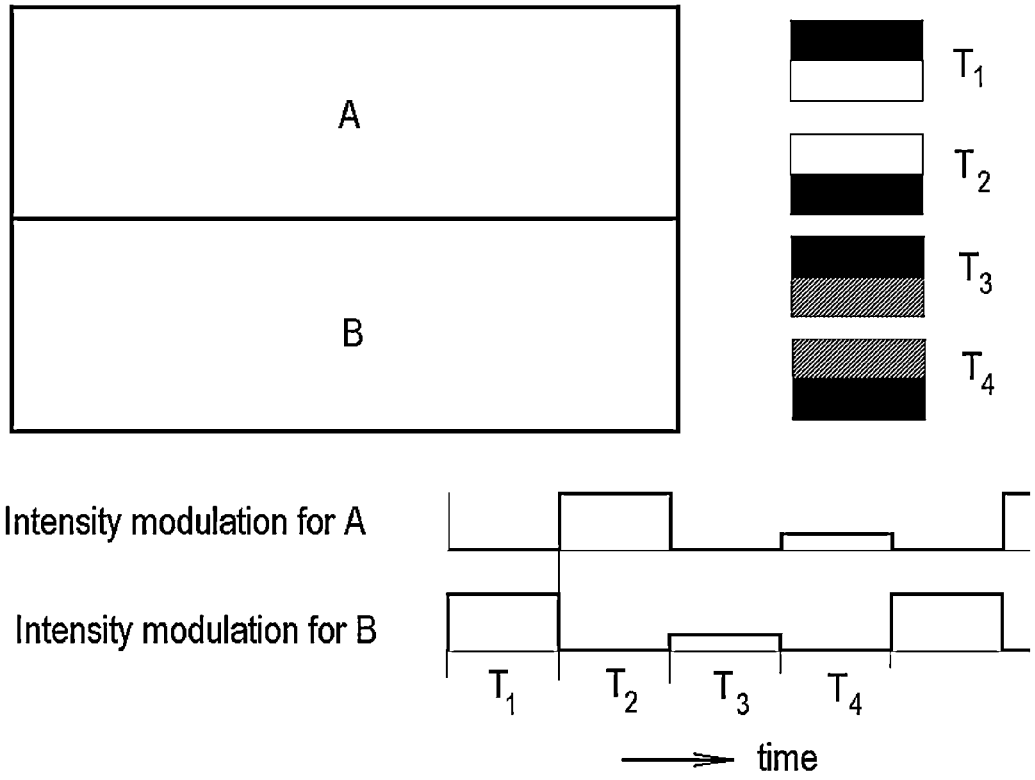
Figure 19:
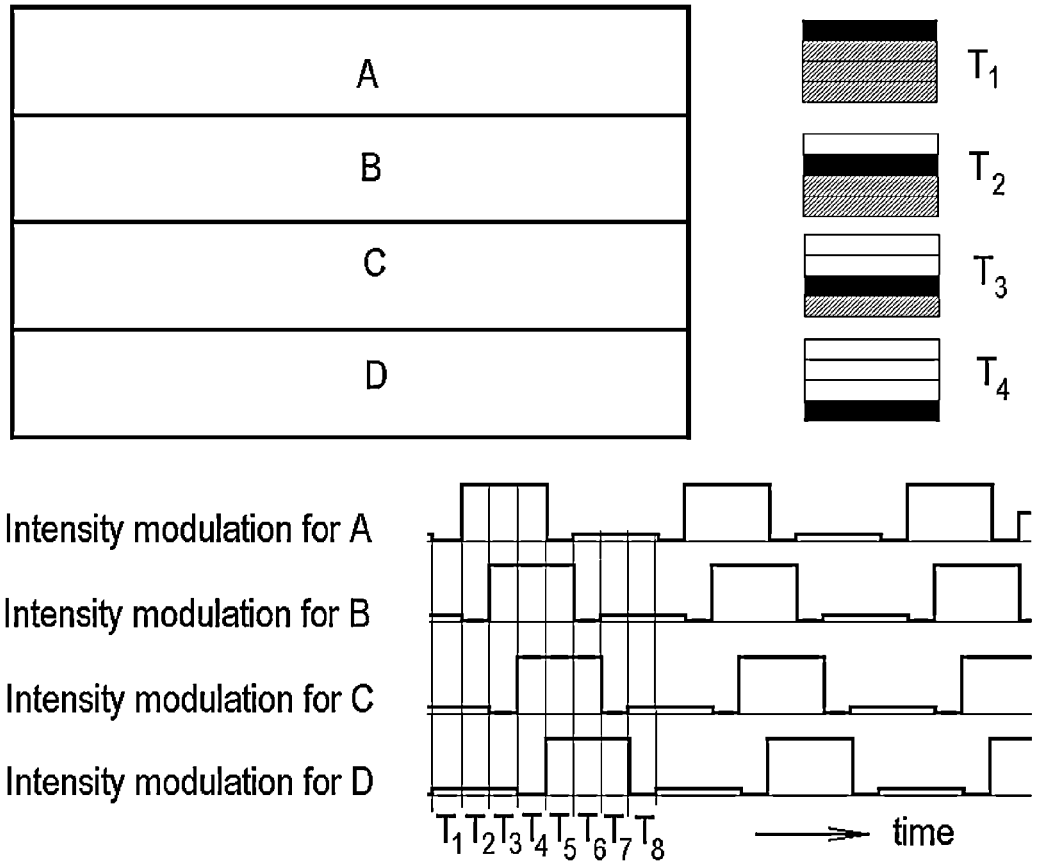

FIG. 12 is the Lena image of FIG. 6 showing bit frames of bit-7 of red, green and blue colors;

FIG. 13 is the Lena image of FIG. 6 with clusters of pixels in each block showing bit plane image of MSB of green color;

FIG. 14 is a graph showing that pulse width modulation of the two most significant bits is useful to reduce power consumption and also to reduce the dynamic range of the intensity of backlight;

FIG. 15 is the Lena image of FIG. 6 showing an image to be displayed during a first time interval of pulse width modulation of bits 8 and 7, as shown on the right side on FIG. 14;

FIG. 16 is the Lena image of FIG. 6 showing an image to be displayed during the second interval of pulse width modulation of bits 8 and 7 of green image, which contains more pixels in an OFF state as compared to that of FIG. 15;

FIG. 17 is the Lena image of FIG. 6 showing an image corresponding to the third interval of pulse width modulation of bits 8 and 7 of green image, which contains more pixels in OFF state as compared to that of FIG. 15 and FIG. 16;

FIG. 18 is an illustration of nibble slice addressing (NSA) of AMLCD and intensity control of backlight;

FIG. 19 is an illustration of nibble slice addressing of AMLCD and intensity profile of backlight; and FIG. 20 is a chart of the number of clusters with two hundred fifty-six (16×16) pixels of same state (ON/OFF) in bit frames of images.

DETAILED DESCRIPTION OF THE INVENTION

Certain terminology is used in the following description for convenience only and is not limiting. Unless specifically set forth herein, the terms "a", "an" and "the" are not limited to one element but instead should be read as meaning "at least one". The words "right," "left," "lower," and "upper" designate directions in the drawings to which reference is made. The terminology includes the above-listed words, derivatives thereof and words of similar import.

Bit-slice addressing was proposed by T. N. Ruckmongathan in "An addressing technique to drive blue phase LCDs, IDW'10" (full citation above) to be used with blue phase LCD because they have sub-millisecond response times. However, blue phase LCDs are not yet in production. Response times of active matrix LCD (AMLCD) are in the range of a few milliseconds. Multi-bit-slice addressing that uses a few bits at a time to drive the AMLCD may be a trade-off between response times and hardware complexity of drivers. In bit-slice addressing (BSA) the LCD is used as a dynamic mask to display image of one bit at a time (referred to as bit frame); one after another for all the bits at a sufficiently fast rate to avoid flicker. For example bit frames can be displayed at 800 Hz to achieve the conventional frame rate of 100 Hz. The intensity of backlight is simultaneously controlled so that it is proportional to the bit-weight of the bit $$(\text{Intensity} = \sum_{i=0}^{g-1} b_i \cdot 2^i;$$

where in $2^i$ is the bit-weight of bit-i) that was used to refresh the LCD for the bit frame that is being displayed at a given instant of time. Intensity of backlight when bit frame of the most significant bit (MSB) is 128 times the intensity of backlight for the bit frame of the least significant bit (LSB).

Figure 1:
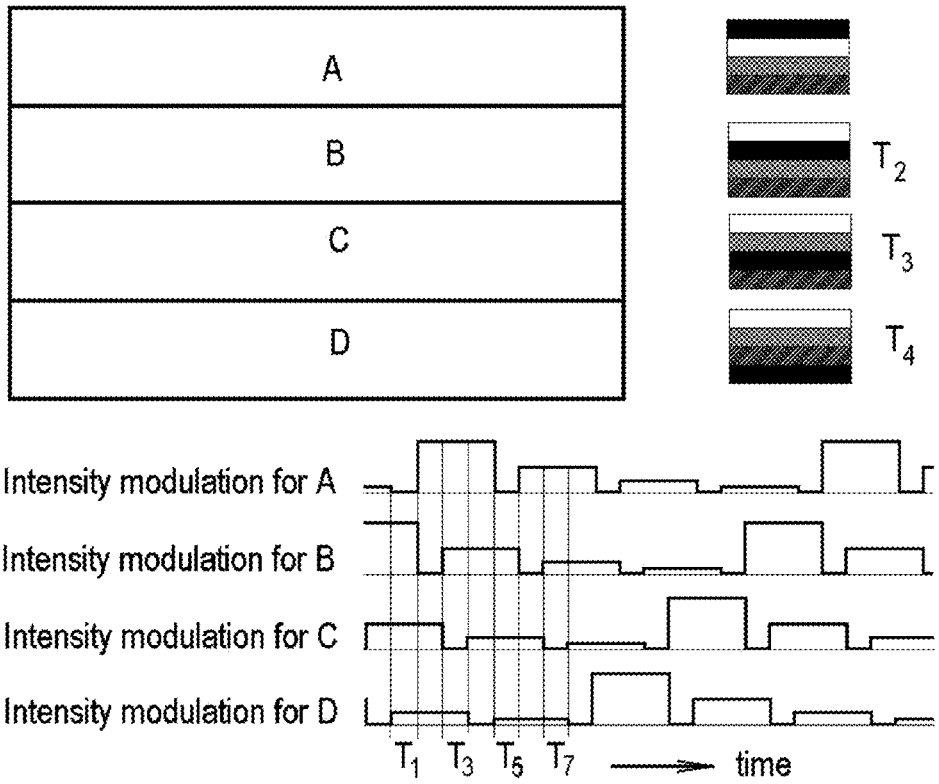

According to one embodiment of the present disclosure, bit slice addressing of AMLCD is described. However, the same method can be used to refresh bi-stable displays, for example ferroelectric liquid crystal displays (FLCD). As an example, consider an AMLCD consisting of N rows and M columns and response times short enough to display images frames at 400 Hz. Pixels in the AMLCD can be grouped into several large horizontal clusters of pixels or vertical clusters of pixels if the display is scanned column wise. For example, clusters A to D are shown in FIG. 1. Each of the clusters is formed with pixels in (N/4) rows and M columns. At a given instant of time, backlight to one of the cluster is switched OFF so that the pixels in that cluster can be refreshed sequentially one row at a time with one bit of gray scale so that pixels are either turned ON, gray scale, or OFF depending on that bit. Pixels are switched to intermediate gray scale when data voltages corresponding to multiple number of bits are used to refresh the display. Back-light is switched ON after scanning the N/4 rows in that cluster and the intensity of backlight is controlled to be proportional to the bit-weight of the bit that was used to refresh the cluster. For example, if pixels in cluster-A are refreshed at time $T_1$ using the most significant bit (MSB) of each color (R, G and B) with its backlight switched OFF, then the backlight intensity is set to the maximum intensity during $T_2$, $T_3$, and $T_4$. Pixels in N/4 rows of cluster-B are refreshed by using the next significant bit of the image with its backlight OFF during $T_2$ and the backlight intensity is set to 50% of the maximum intensity during the following 3-time intervals i.e. $T_3$ to $T_5$. Pixels in cluster-C are refreshed by using $3^{rd}$ significant bit by switching OFF its backlight during the time interval $T_3$ and intensity backlight to cluster-C is controlled to be 25% of the maximum during $T_4$ to $T_6$. Backlight to cluster-D is switched OFF during the time interval $T_4$ and pixels in that cluster are scanned by using the $4^{th}$ significant bit of the image. Backlight intensity of cluster-D is set to 12.5% during the subsequent 3-time intervals that follows $T_4$ i.e., $T_5$ to $T_7$. It is possible to display 16 gray scales with a refresh rate of 100 Hz in LCDs that are fast enough for a frame frequency of 400 Hz. This process can be continued if the response times of AMLCD are shorter, such as an LCD that can display frames at a frequency of 800 Hz. Then, the durations $T_5$ to $T_8$ can be utilized to refresh cluster-A to cluster-D by using $5^{th}$ to $8^{th}$ significant bits of gray scale in the same manner as $T_1$ to $T_4$. Intensity of backlight is controlled to be 6.25%, 3.13%, 1.56% and 0.78%, respectively. That is, the intensity is reduced by 50% for each successive bit. The order in which the bits are selected to refresh each cluster has a lot of combinations and image equivalent to the conventional frame as long as each bit is used to refresh each cluster once, and all bits are used to refresh all clusters. Then, the image will be perceived as a gray scale image when the frame rate is sufficiently fast to avoid flicker.

Figure 2:
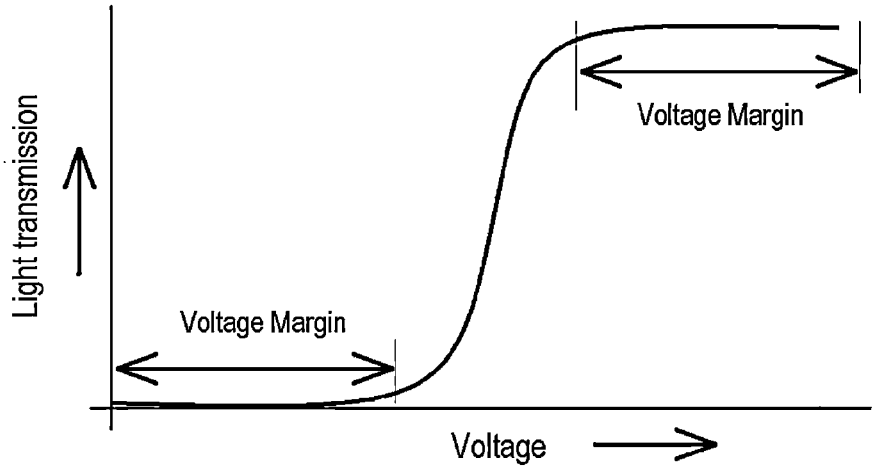
Figure 3:
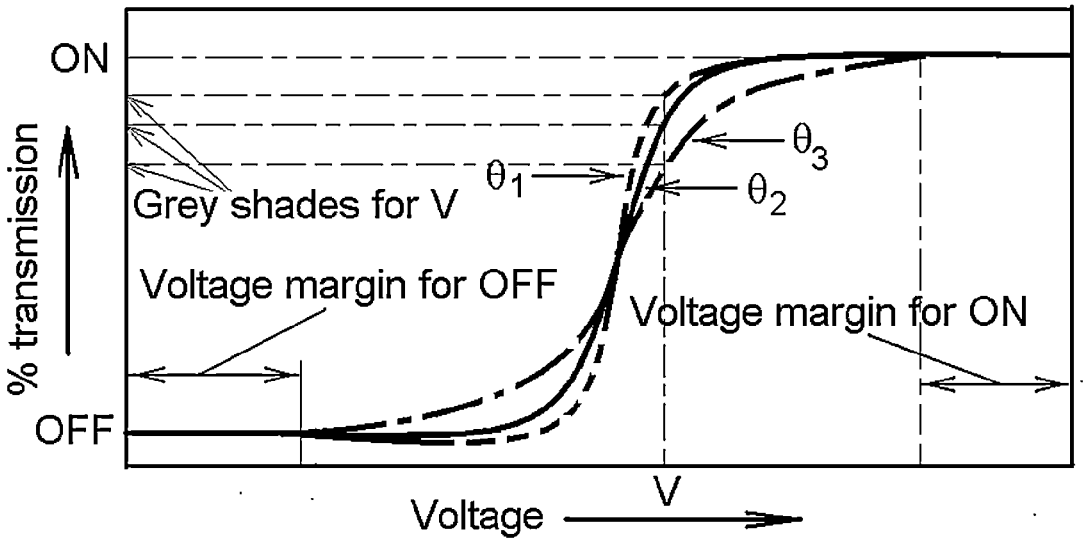
Figure 4:
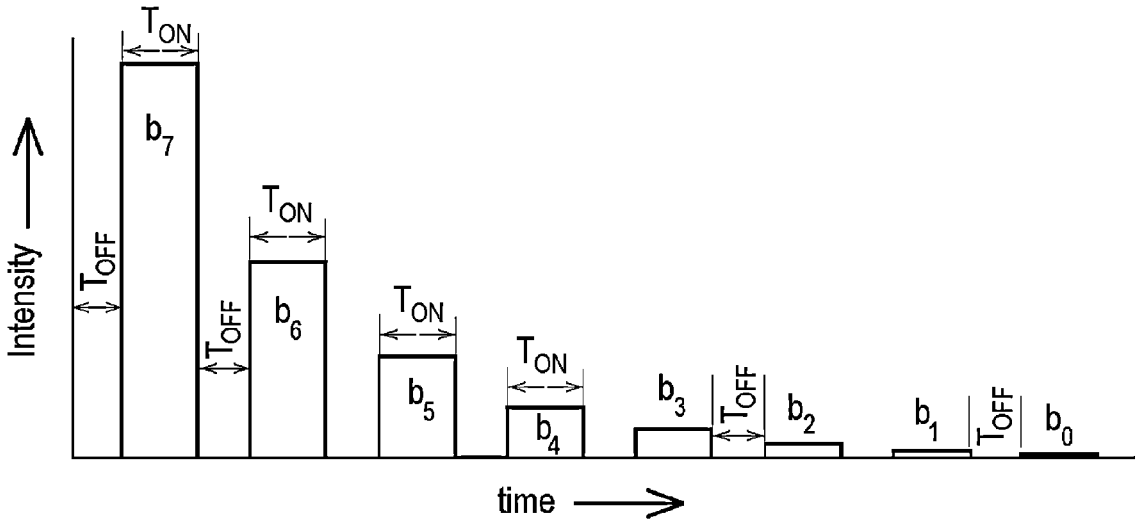

Bi-stable displays can be used to display gray scales when they are driven with bit slice addressing because BSA uses just one bit at a time to refresh the display. Simple data drivers that can apply any one of two voltages (equivalent to 1-bit A/D) to turn pixels ON/OFF are adequate to display gray scales in LCD if bit slice addressing is used. Voltage margin to drive pixels to ON and OFF are large in LCD, as shown in FIG. 2. Hence, drive voltages need not be controlled down to a few mV with 8 to 10 bit A/D converters as in the case of conventional AMLCDs. Therefore, displays driven with bit-slice addressing need not have metallization of address lines to reduce drop in voltage from one end of the data line to the other end. Viewing angle characteristics of the LCD driven with BSA will be relatively independent of gray scale because pixels are either turned ON or OFF and therefore light transmission through the cell has small deviation in transmission even with large changes in voltage across pixel due to threshold and saturation in electro-optic response of LCD as illustrated in FIG. 3. Hence, color purity of images will also be better because viewing angle characteristics of the R, G and B pixels are almost independent of the intensity of the color pixels. Intensity modulation of backlight for 256 gray scale with 8-bits is shown in FIG. 4. The intensity of backlight is small (less than 1% of the maximum intensity). The intensity profile will have the same effect as the intensity decay in a CRT which is useful to avoid the motion blur in AMLCD. It is not necessary to introduce blank frames during alternate fields, the intensity profile of backlight will be effective to suppress motion blur.

Figure 5:
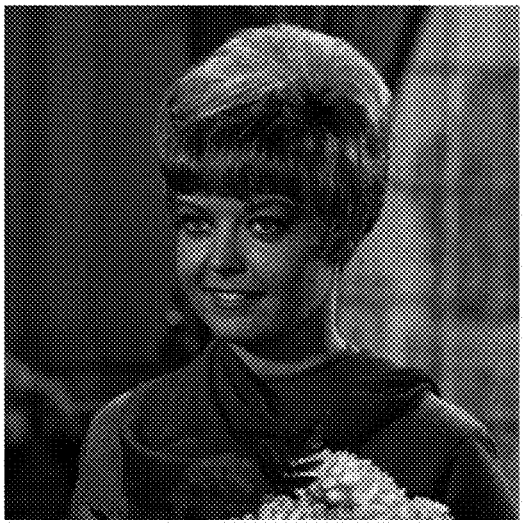
Figure 7:
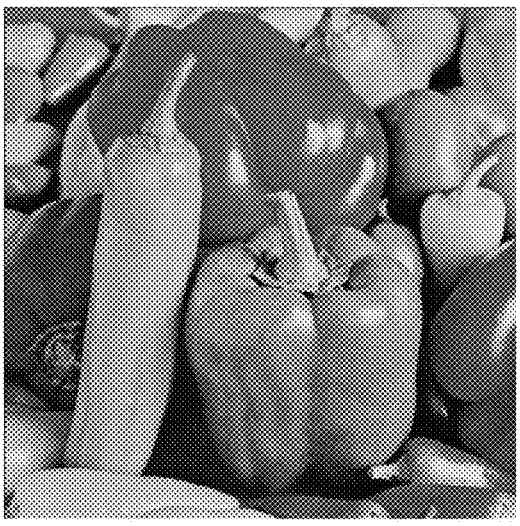

Analysis of sixteen (16) color images and twenty-eight (28) gray scale images, or six hundred and eight (608) (16×3×8+28×8) bit frames led to the following results. Percentage of OFF pixels ranged from forty percent (40%) to sixty percent (60%) in bit frames of six LSBs of the eight (8) bits. Percentage of OFF pixels in bit frames of the two MSBs has a wider variation that depends on the brightness of the images. For example, the percentage of OFF pixels in bit planes of three images in FIGS. 5 to 7 are shown in Table 1. These are standard images used for image processing.

Table 1 shows the statistics of some bit-frame images. The number pixels that are OFF in each bit frame.

TABLE 1

| Image | $b_7$ | $b_6$ | $b_5$ | $b_4$ | $b_3$ | $b_2$ | $b_1$ | $b_0$ |
|---|---|---|---|---|---|---|---|---|
| Girl-red | 87 | 60 | 44 | 48 | 50 | 47 | 46 | 59 |
| Girl-green | 92 | 76 | 57 | 61 | 53 | 54 | 55 | 58 |
| Girl-blue | 94 | 79 | 61 | 64 | 56 | 50 | 47 | 53 |
| Lena-red | 20 | 26 | 53 | 50 | 49 | 50 | 50 | 49 |
| Lena-green | 69 | 52 | 57 | 49 | 50 | 50 | 51 | 49 |
| Lena-blue | 78 | 30 | 51 | 48 | 49 | 50 | 50 | 50 |
| Pepper-red | 32 | 50 | 51 | 51 | 50 | 50 | 51 | 51 |
| Pepper-green | 50 | 66 | 53 | 53 | 54 | 54 | 53 | 53 |
| Pepper-blue | 91 | 58 | 53 | 59 | 54 | 53 | 53 | 53 |

Light incident on OFF pixels does not reach the eye of the person(s) viewing the display, and therefore it is not useful. Backlight power can be saved if backlight is switched OFF to these pixels. It is feasible only when a large cluster of pixels are OFF because the number of clusters should be small from a practical point of view. Large clusters are present mostly in bit frames of a few MSBs, as shown Table 2. OFF pixels in bit frames of LSBs are scattered and therefore they are not useful for saving power in a cost effective manner.

Figure 8:
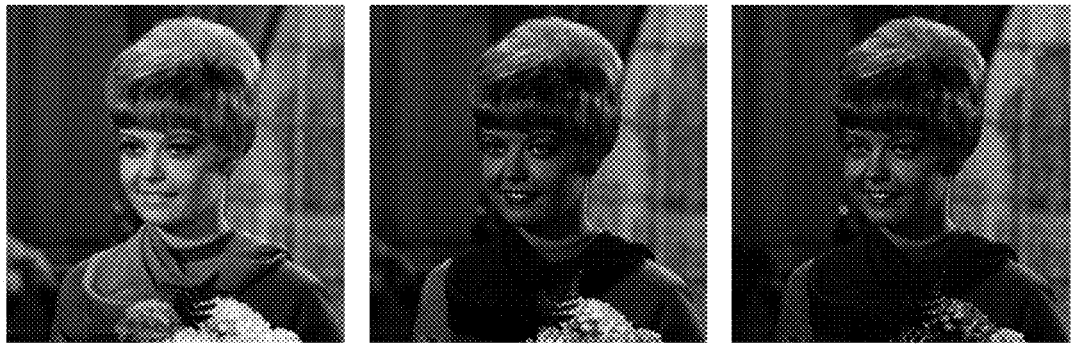
Figure 9:
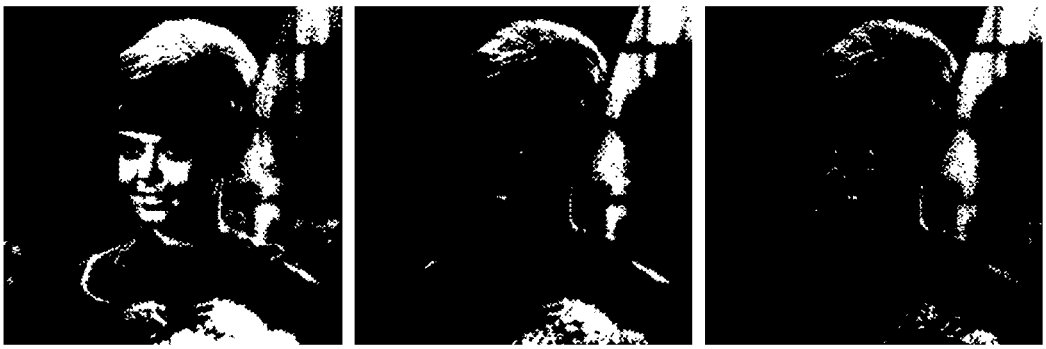
Figure 10:
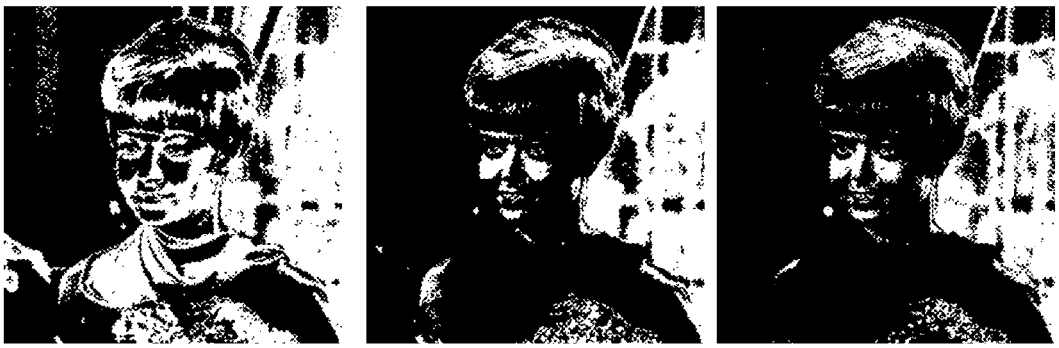
Figure 11:
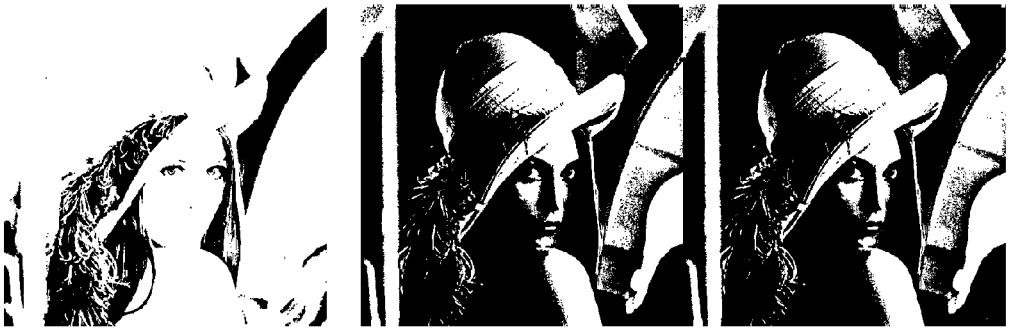

FIG. 20 shows the number of clusters with two hundred fifty-six (256) (16×16) pixels of same state (ON/OFF) in bit frames of images. Monochrome images of the three primary colors of the image Girl are shown in FIG. 8. Bit frames of MSB (bit-8) and bit-7 of primary colors of the image Girl are shown in FIGS. 9 and 10, respectively. Similarly, the bit frames of the bit-8 and bit-7 of primary colors are shown in FIGS. 11 and 12, respectively. The number of OFF pixels in bit frames of MSB and the next significant bit (bit-7) depends on the brightness of the original image as evident from Table 1 above. The MSB bit of the image of Girl has more OFF pixels (more than 87% in all the three primary colors, as shown in Table 1) because its brightness is less as compared to the image of Lena. The number of OFF pixels in bit frame of Lena is less (just 20% for the color red, 69% for green and 78% for blue). In LCDs, power can be saved by switching OFF light selectively because it is more practical when large sized clusters are OFF. Bit frames of a few most significant bits have large clusters of OFF pixels and backlight power can be saved by selectively switching OFF the backlight to large clusters of OFF pixels.

Saving in backlight power diminishes rapidly as we move from MSB to LSB because intensity of backlight reduces by 50% for each successive lower significant bits and also because large clusters of pixels (in the same state) are more common in bit frames of most significant bits than in bit frames of least significant bit. There are several schemes to save power by switching OFF backlight to large clusters of pixels, but this is outside the scope of this disclosure. However, the potential to save power is shown in FIG. 13. Fifty-six (56) clusters out of two hundred fifty six (256) clusters have all pixels OFF and therefore about 20% of backlight power can be saved if these clusters are illuminated with independent backlights. Pulse width modulation for the two MSBs (bits 8 and 7) is useful to form large clusters and thereby reduce power consumption of the backlight. Dynamic range of backlight intensity is also reduced with this approach as shown in FIG. 14. About 20% to 40% reduction in backlight power can be achieved by switching OFF backlight selectively to clusters of two hundred fifty six (256) pixels depending on the image. It is possible to achieve reduction in power consumption of backlight even when displaying static images with good brightness and high contrast.

Another embodiment of the present disclosure is Multi-bit Slice Addressing of AMLCD. Multi-bit slice addressing (MBSA) is a compromise solution so that at least some of the advantages of bit-slice are retained when the response times of LCD is not fast enough for bit-slice addressing.

Nibble Slice Addressing of AMLCD

A technique to drive the AMLCD with four bits (nibble) at a time is described. Pixels in an LCD can be split into two large clusters of pixels. Each cluster is illuminated by an independent backlight source with independent intensity control. The expression for intensity of pixel is $$\sum_{i=0}^{g-1} b_i \cdot 2^i,$$

wherein $b_i$ is either 0 or 1. This expression is directly used in implementation of BSA. This expression can also be re-written for the nibble-slice addressing of AMLCD as shown in expression (1) below:

$$\text{Intensity} = 2^4 \sum_{i=4}^{7} b_i \cdot 2^{(i-4)} + \sum_{i=0}^{3} b_i \cdot 2^i \tag{1}$$

Backlight to the cluster-A (consisting of pixels in N/2 rows) is switched OFF and pixels in this cluster are refreshed with the 4-most significant bits of gray scales as the data during the time interval $T_1$, Intensity of backlight for the cluster-A is set to the maximum during the time interval $T_2$ because the most significant nibble was used to refresh the cluster-A during $T_1$. Pixels in N/2 rows of the cluster-B are refreshed during $T_2$ with the least significant nibble of gray scale with its backlight switched OFF. Intensity of the backlight is set to (1/16) of the maximum intensity during $T_3$ for the cluster-B while the pixels in cluster-A are refreshed with the least significant nibble of the gray scale data with its backlight switched OFF. Pixels in cluster-B are refreshed with most significant nibble with its backlight switched OFF during $T_4$ and the intensity of backlight to cluster-A is set to (1/16) of the maximum intensity as shown in FIG. 18. The LCD can also be refreshed with the following scanning sequence: most significant nibble (MSN) for cluster-A, MSN for cluster-B, least significant nibble (LSN) for cluster-A followed by LSN for cluster-B and the intensity of backlight is controlled accordingly. Time taken to refresh the AMLCD with nibble slice addressing is equal to duration of frames in the conventional AMLCD. If blanking of alternate frames to suppress motion blur is taken into consideration, then the display refresh rate of NSA is the same as the conventional AMLCD, and the response time of 2-5 ms is sufficient for nibble-slice addressing (NSA) of AMLCD.

Hardware complexity of data drivers is reduced by 50% as compared to the conventional data drivers of AMLCD because 4-bit analog to digital converters (A/D) can be used in the data drivers in place of the 8-bit A/D converters that are employed for displaying 256 gray scales. If the response time of AMLCD is further reduced; then one can consider driving the panel by using 3-bit (8-gray scales) and 2-bit (4-gray-scals) in each multi-bit frame. Nibble addressing can also be implemented by splitting the pixels in LCD to form 4 clusters as described here. Pixels in N/4 rows of cluster-A are refreshed with the MSN of gray scale during $T_1$ and the backlight is switched ON with maximum intensity during $T_2$ to $T_4$. Similarly, pixels in the other three clusters are refreshed with backlight OFF during the time intervals $T_2$, $T_3$ and $T_4$ respectively and the backlight of the respective clusters are set to the maximum intensity during 3-subsequent time intervals; i.e. during $T_3$-$T_5$ for the cluster-B, $T_4$-$T_6$ for the cluster-C and $T_5$-$T_7$ for the cluster-D. Pixels in Cluster-A to Cluster-D are refreshed by switching OFF the backlight during $T_5$, $T_6$, $T_7$ and $T_8$ respectively and the backlight is switched ON with the intensity set at 1/16 of the maximum intensity during $T_6$-$T_8$, $T_7$-$T_9$, $T_8$-$T_{10}$ and $T_9$-$T_{11}$ for the clusters A, B, C and D respectively. This process is repeated continuously with backlight intensity profile as shown in FIG. 19 and the frame rate depends on the response times of AMLCD. Maximum intensity of the backlight is lower in case of four clusters as compared to that of two clusters because the duty cycle of the backlight is 75% as compared to 50% duty cycle in case of two clusters. Data drivers that are capable of applying one of sixteen voltages is adequate for displaying gray scales in AMLCD that is driven by nibble slice addressing (NSA).

Dual Bit Slice Addressing of AMLCD

Intensity of pixels can be rewritten as shown in expression (2) below for dual bit slice addressing of AMLCD.

$$I = 2^6\sum_{i=2}^{3} b_i \cdot 2^{(i-6)} + 2^4\sum_{i=0}^{1} b_i \cdot 2^{(i-4)} + 2^2\sum_{i=2}^{3} b_i \cdot 2^{(i-2)} + \sum_{i=0}^{1} b_i \cdot 2^i \quad (2)$$

Pixels in N/4 rows of clusters A to D are sequentially refreshed with two bits of gray scale at a time by switching OFF the corresponding backlight during $T_1$, $T_2$, $T_3$ and $T_4$ respectively. Intensity of backlight is set to the maximum if the most significant two bits are used to refresh the cluster and the backlight is ON with a duty cycle of 75% because backlight is switched ON during three time intervals following the refresh period. A frame in the conventional sense consists of sixteen (16) time intervals because it takes four bit frames that can display 4-gray scales display to display two hundred fifty six (256) gray scales.

Multi-bit slice addressing (MBSA) also relies on fast responding devices like LED as backlight source for addressing AMLCD as in the case of bit slice addressing. However, viewing angle characteristics will no longer be independent of gray scales with MBSA and therefore color purity of images will not be as good as BSA if MBSA is employed. Response times will also depend on gray scales to some extent in MBSA. Nibble slice addressing is feasible with the state of the art AMLCDs. Some of the advantages of bit slice addressing; viz., low hardware complexity of data drivers, reduction of motion blur, low power consumption of backlight can be retained with multi-bit slice addressing. Backlight power can be saved with techniques proposed by T. Shiga and S. Mikoshiba, in SID'03 Technical Digest, p. 1364 (2003) and JSID 14/12, p. 1103 (2006).

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A method of displaying an image on a display device, the display device having a plurality of clusters, each of the plurality of clusters having (i) a plurality of pixels, and (ii) an independent light source associated therewith, the method comprising:

a. illuminating each of the plurality of clusters with its associated independent light source, wherein the plurality of clusters are in the range of two (2) to four (4) clusters;

b. refreshing the plurality of pixels in a cluster with one or more bits of gray scale;

c. simultaneously with the refreshing of step (b), switching off the light source associated with the cluster where the plurality of pixels are being refreshed;

d. switching on the light source associated with the cluster when the plurality of pixels have been refreshed, the light source being switched on with a predetermined intensity of light; and e. sequentially repeating steps (b)-(d) for each of the plurality of clusters at a rate that is fast enough to eliminate flicker, wherein each of the plurality of clusters is a group of either (i) only horizontal clusters of pixels when the display is scanned row-wise, or (ii) only vertical clusters of pixels when the display is scanned column-wise.

2. The method of claim 1, wherein the plurality of pixels are arranged in rows, and the refreshing of step (b) further comprises sequentially refreshing the plurality of pixels one row at a time with bits of gray scale during a first time interval, wherein the refreshing drives each pixel to a gray scale based on the applied bits of gray scale.

3. The method of claim 2, wherein the predetermined intensity of the light source in step (d) is determined based on the bits of gray scale used during the refreshing of the pixels in that cluster.

4. The method of claim 3, wherein the intensity of the light source is a maximum intensity if the most significant bits of the bits of gray scale are used for refreshing the plurality of pixels.

5. The method of claim 1, wherein the display device is an active matrix LCDs (AMLCD) or a ferroelectric liquid crystal display (FLCD).

6. A method of displaying an image on a display device, the display device having a plurality of predefined clusters of pixels, each cluster having an independent light source, each of the plurality of clusters having a plurality of pixels arranged in rows, the method comprising:

a. sequentially refreshing the plurality of pixels in a predefined cluster of pixels one row at a time with one or more bits of gray scale during a first time interval, wherein the refreshing drives each pixel to a gray scale based on the applied bits of gray scale;

b. simultaneously with the refreshing, switching off an independent light source associated with the predefined cluster of pixels being refreshed in step (a);

c. displaying the plurality of pixels of the cluster refreshed in step (a) after completing the refreshing by switching on the light source associated with the refreshed cluster with a predetermined intensity of light for a subsequent one or more time intervals, wherein the predetermined intensity of light is based on the bits of gray scale used during the refreshing of step (a), wherein the plurality of clusters are in the range of two (2) to four (4) clusters; and d. repeating steps (a) to (c) for each of the predefined clusters using a predefined number of bits of gray scale at a predetermined rate such that the displayed clusters of pixels are perceived by a viewer of the display device as a gray scale image without flicker, wherein each of the plurality of clusters is a group of either (i) only horizontal clusters of pixels when the display is scanned row-wise, or (ii) only vertical clusters of pixels when the display is scanned column-wise.

7. The method of claim 6, wherein in step (d) the number of bits of gray scale is predefined as two (2) bits for dual bit slice addressing, and four (4) intensities are displayed simultaneously.

8. The method of claim 7, wherein the intensity of the light source is reduced by a factor of one fourth for each successive lower twin bits.

9. The method of claim 6, wherein in step (d) the number of bits of gray scale is predefined as four nibble slice addressing, and sixteen (16) intensities are displayed simultaneously.

10. The method of claim 9, wherein the intensity of the light source is reduced by a factor of one sixteenth for each successive group of lower nibble.

11. The method of claim 6, wherein the display device is an active matrix LCDs (AMLCD) or a ferroelectric liquid crystal display (FLCD).

12. The method of claim 6, wherein the intensity of the light source in step (c) is a maximum intensity if the most significant bits of the bits of gray scale are used for refreshing the plurality of pixels in a predefined cluster.

13. The method of claim 6, wherein step (d) further comprises refreshing the predefined clusters in a sequential order.

14. The method of claim 6, wherein the refreshing of step (a) causes the plurality of pixels to display gray scales.

15. The method of claim 6, wherein the refreshing of step (a) further comprises simultaneously scanning pixels in multiple rows using multiline addressing.

* * * * *